US006904867B2

(12) United States Patent
Zamjahn

(10) Patent No.: US 6,904,867 B2
(45) Date of Patent: Jun. 14, 2005

(54) CALCULATED DOSE MEDICINE DISPENSER

(76) Inventor: David B. Zamjahn, 7506 77$^{th}$ St., Chaska, MN (US) 55044

( * ) Notice: Subject to any disclaimer, the term of this patent is extended or adjusted under 35 U.S.C. 154(b) by 0 days.

(21) Appl. No.: 10/843,901

(22) Filed: May 11, 2004

(65) Prior Publication Data

US 2004/0206295 A1 Oct. 21, 2004

Related U.S. Application Data

(63) Continuation-in-part of application No. 10/180,628, filed on Jun. 25, 2002, now Pat. No. 6,779,480.
(60) Provisional application No. 60/300,670, filed on Jun. 25, 2001.

(51) Int. Cl.$^{7}$ ..... G09F 9/00
(52) U.S. Cl. ..... 116/308; 116/309; 215/230; 215/DIG. 3; 206/459.5; 141/381
(58) Field of Search ..... 116/308–309, 311–312, 116/316–318; 215/230, DIG. 3; 206/459.1, 459.5; 141/381; 222/154, 157–158

(56) References Cited

U.S. PATENT DOCUMENTS

| | | | | | |
|---|---|---|---|---|---|
| 1,280,700 | A | * | 10/1918 | Fouche | 141/381 |
| 1,986,741 | A | * | 1/1935 | Moser | 141/381 |
| 2,185,699 | A | * | 1/1940 | Zeugner | 141/381 |
| 3,191,645 | A | * | 6/1965 | Dailey | 141/381 |
| 4,011,829 | A | * | 3/1977 | Wachsmann et al. | 116/308 |
| 4,269,319 | A | * | 5/1981 | Rubens | 215/228 |
| 4,920,912 | A | * | 5/1990 | Kirkling | 116/308 |
| 5,984,122 | A | * | 11/1999 | Barker et al. | 215/230 |
| 6,276,533 | B1 | * | 8/2001 | Kaplan | 206/534 |
| 6,779,480 | B2 | * | 8/2004 | Zamjahn | 116/308 |

* cited by examiner

*Primary Examiner*—Christopher W. Fulton
*Assistant Examiner*—Tania C. Courson
(74) *Attorney, Agent, or Firm*—Gray, Plant, Mooty, Mooty & Bennett, P.A.; Malcolm D. Reid

(57) ABSTRACT

A calculated medicine dose dispensing apparatus includes a medicine bottle and a calculated dose medicine dispenser specific to the medicine bottle and a particular medicine. The medicine bottle has a neck and a bottle cap installed on the neck. The dose dispenser includes a cup in the shape of a truncated cone with a large diameter open end and an end wall closing the small diameter end. The end wall has a circular indent defined by an indent sidewall. The dose cup fits on the bottle cap with the large open end facing down and the bottle cap frictionally installed in the cup indent. A dial assembly is installed on the dose cup on the exterior of the end wall. The dial assembly calculates the proper dose of the medicine for the patient according to a patient parameter such as weight. The dial assembly includes a dial and a data disc. The data disc is installed on the dose cup end wall and carries at least two information sets that are circularly arranged, spaced apart information bits. Each information bit of one set is functionally related to an information bit of the other set, such as patient weight to medicine dose. The dial includes a dial plate installed over the data disc. The dial plate has one sight window corresponding to each information set. Rotation of the dial plate over the data disc displays functionally related information bits in the sight windows.

21 Claims, 6 Drawing Sheets

17
18
20
26
35
48
19
34
49
51
10

CALCULATED DOSE MEDICINE DISPENSER

CROSS REFERENCE TO RELATED APPLICATIONS

This application is a continuation-in-part of U.S. application Ser. No. 10/180,628 filed Jun. 25, 2002 now U.S. Pat. No. 6,779,480, which application claims the benefit of U.S. Provisional Patent Application Ser. No. 60/300,670 filed Jun. 25, 2001.

BACKGROUND OF THE INVENTION

Inaccurate medication dosing in the pediatric patient population (three years of age and younger) is common and costly. Medical literature abounds with statistics and objective data supporting the finding that inaccurate medication dosing in the pediatric patient population is a common problem. For example, a significant number of pediatric patients are: hospitalized with medication dosing errors; die as a result of dosing errors; taken to emergency rooms with persistent fever-related illnesses due to under-dosage with acetaminophen; and treated for over-dosage with acetaminophen. Studies confirm that a large majority of caregivers: fail to give the required dosage of the over-the-counter medication acetaminophen; do not accurately read and follow labeling instructions; fail to increase dosage as the pediatric patient's age or weight increases; or give less than the manufacturer's recommended dosage. It is also known that over-the-counter pediatric medications commonly have no specific instructions for dosing a child under the age of two. For most over-the-counter pediatric medication in liquid form, the dosing instructions are by "age" for children under age two and by "weight" for children above age two, which is conflicting and unclear. When the medication bottle is removed from the packaging and the packaging is discarded, the complicated dosing instructions, which are generally on the packaging, are no longer available to the caregiver.

There is a need for greater assurance that the medication recommended for the pediatric population is dosed correctly. Medication labeling is usually the only tool available to assure the consumer of accurate dosing. However, labeling has proven to be ineffective, confusing, costly, and controversial. Improving the label will not dramatically improve the rate of accuracy in dosing medications. A simple, inexpensive, consumer friendly device for dosing accuracy should replace the current standard of labeling. And, the dosing information should be integral to the medication container.

SUMMARY OF THE INVENTION

The invention comprises on the one hand a calculated dose medicine dispenser having particular application in dispensing pediatric medicine. On the other hand the invention comprises a calculated dose medicine dispenser apparatus which includes the medicine dispenser in conjunction with a bottle or similar container of medicine having a conventional cap of the type that is typically screwed on the threaded neck of the bottle which may or may not be in conjunction with a child-proof interlock.

The calculated dose medicine dispenser apparatus provides a medicine container and a device for determining dosage for prescriptive and over-the-counter medications, as well as for administering the proper dose to the patient. It utilizes the existing closure cap on a medicine bottle. The calculated dose medicine dispenser includes a dial indicator for calculating the proper dose of the specific medicine according to a variable of the individual such as weight. The dial indicator either minimizes the need for detailed labeling or is adjunct to such labeling. It provides an almost error proof method for the dispensing of the medicine to the patient.

The calculated dose medicine dispenser includes a dispenser or dosage cup. Medicine from the medicine bottle is poured into the cup. The medicine will typically be in liquid form but could as well be powdered or granular. The cup can have a sidewall of any suitable or desired shape. The cup can have a cylindrical or modified conical shape such as a truncated conical sidewall with graduation marks to show the amount of medicine poured into the cup. The large diameter open end is the top end when the cup is used to dispense medicine. The small diameter end is the closed end and includes a bottom wall with an indent formed in a shape corresponding to the top of a bottle cap on a medicine bottle. The empty dosage cup fits or snaps over the medicine bottle with the bottle cap frictionally lodged in the indent of the dosage cup bottom wall. When engaged with a child proof cap, this provides a further deterrent to a child getting into a good tasting medicine.

The calculated dose medicine dispenser is specific to a given medicine. A dial assembly is assembled to the cup in a position so that it faces up when the cup is in an inverted position and installed on a medicine bottle. The dial assembly includes a dial and a data disc. The data disc contains data sets arranged in circular arrays that pertain to first and second variables related to the dosage to be given a patient. One variable is related to the patient such as the weight or age of the patient. Another variable is the proper dosage that corresponds to the first variable. The data disc is integral with or installed on the exterior surface of the bottom wall of the dosage cup. The dial is installed over the data disc and connects to the interlocking structure on the cup. The dial has a cylindrical rim and a dial plate. The rim fits around the data disc so that the data disc is confined between the bottom wall of the cup and the dial plate. The dial plate has sight window openings positioned for selective viewing of functionally related information bits on the data disc. The dial rotates with respect to the data disc in order to move the dial plate to view functionally related information bits from the data disc.

IN THE DRAWINGS

DESCRIPTION OF A PREFERRED EMBODIMENT

Figure 1:
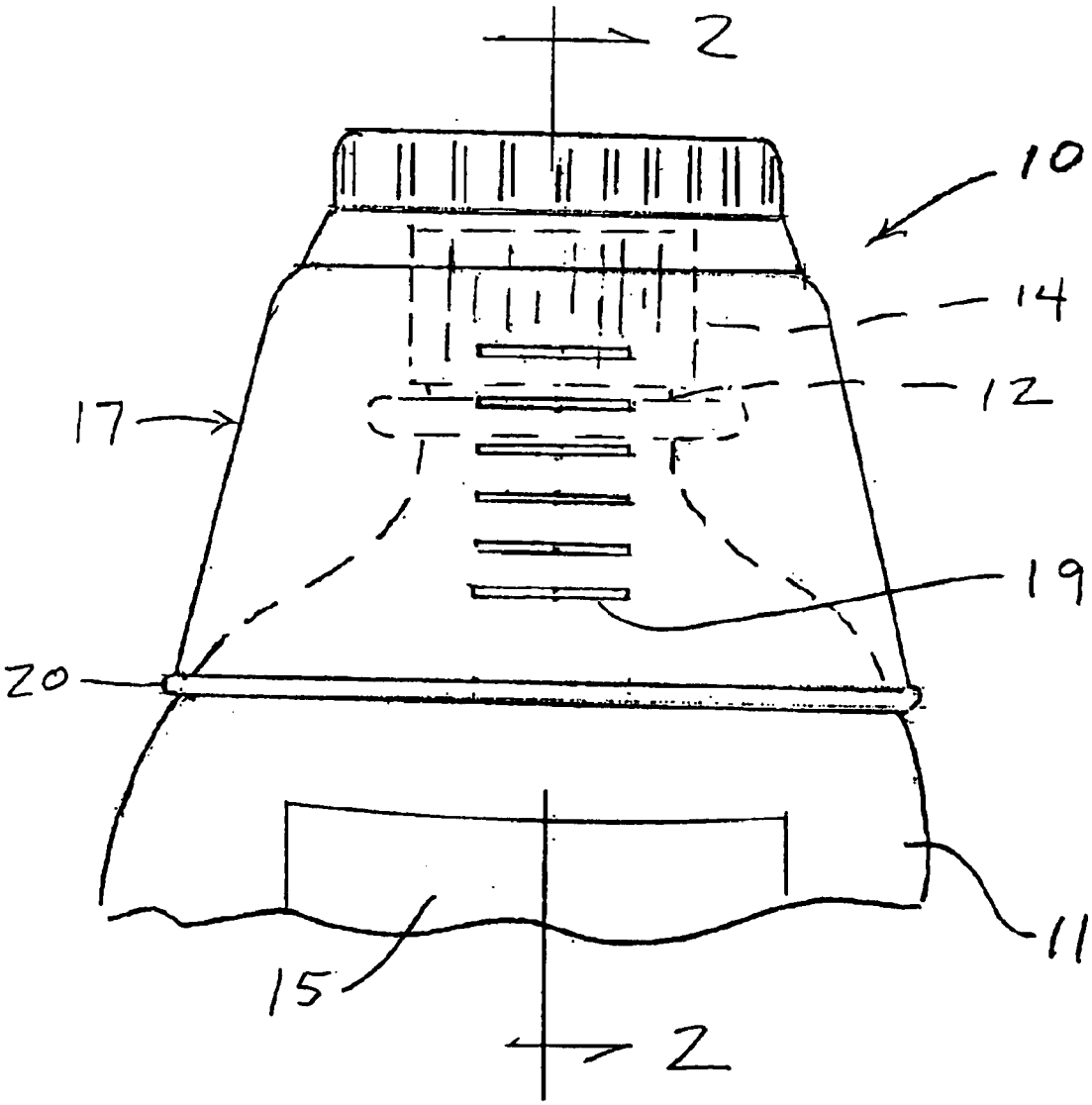
FIG. 1 is a front plan view of a calculated dose medicine dispenser according to the invention installed on a medicine bottle.
Figure 2:
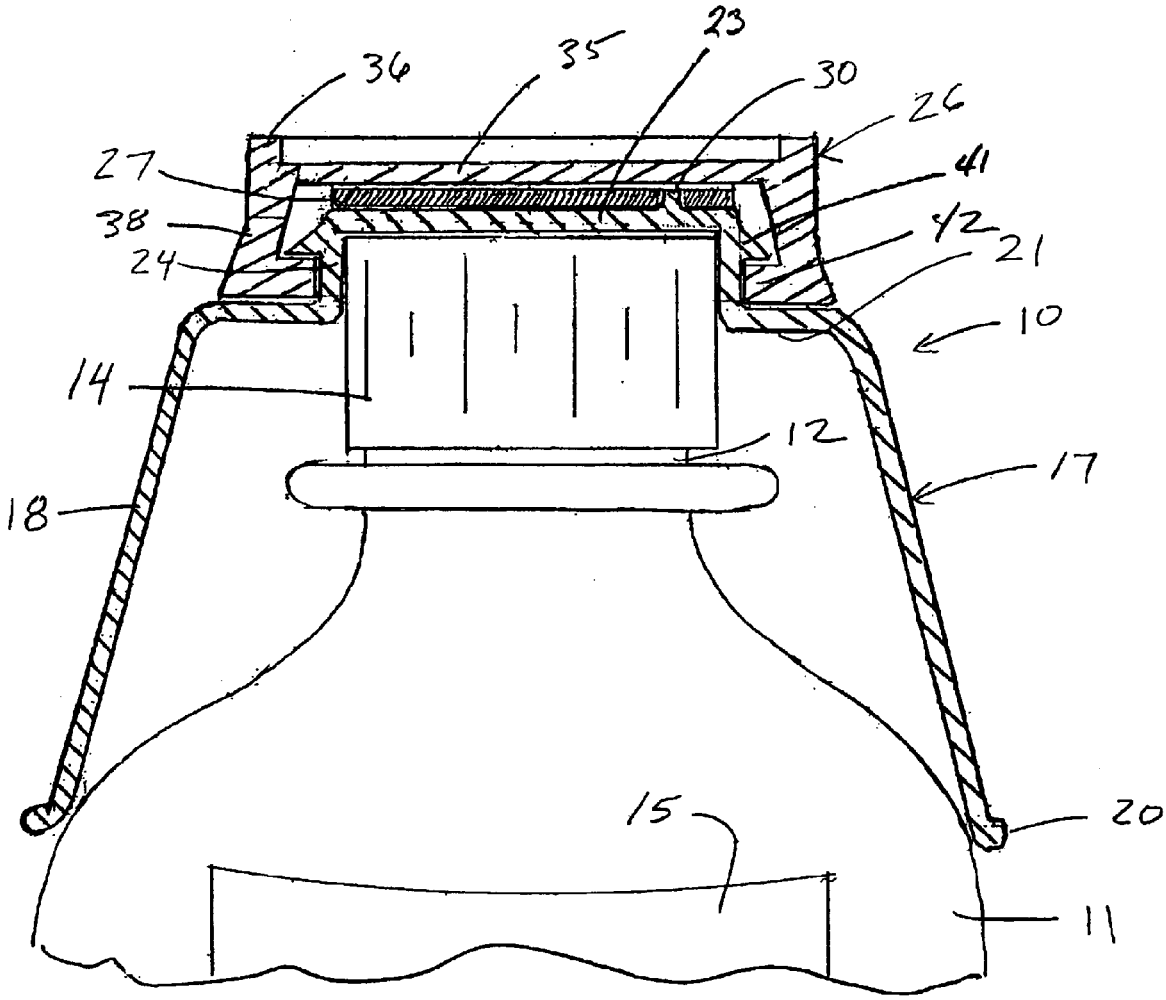
FIG. 2 is an enlarged sectional view of the calculated dose medicine dispenser of FIG. 1 taken along the line 2—2 thereof.
Figure 2A:
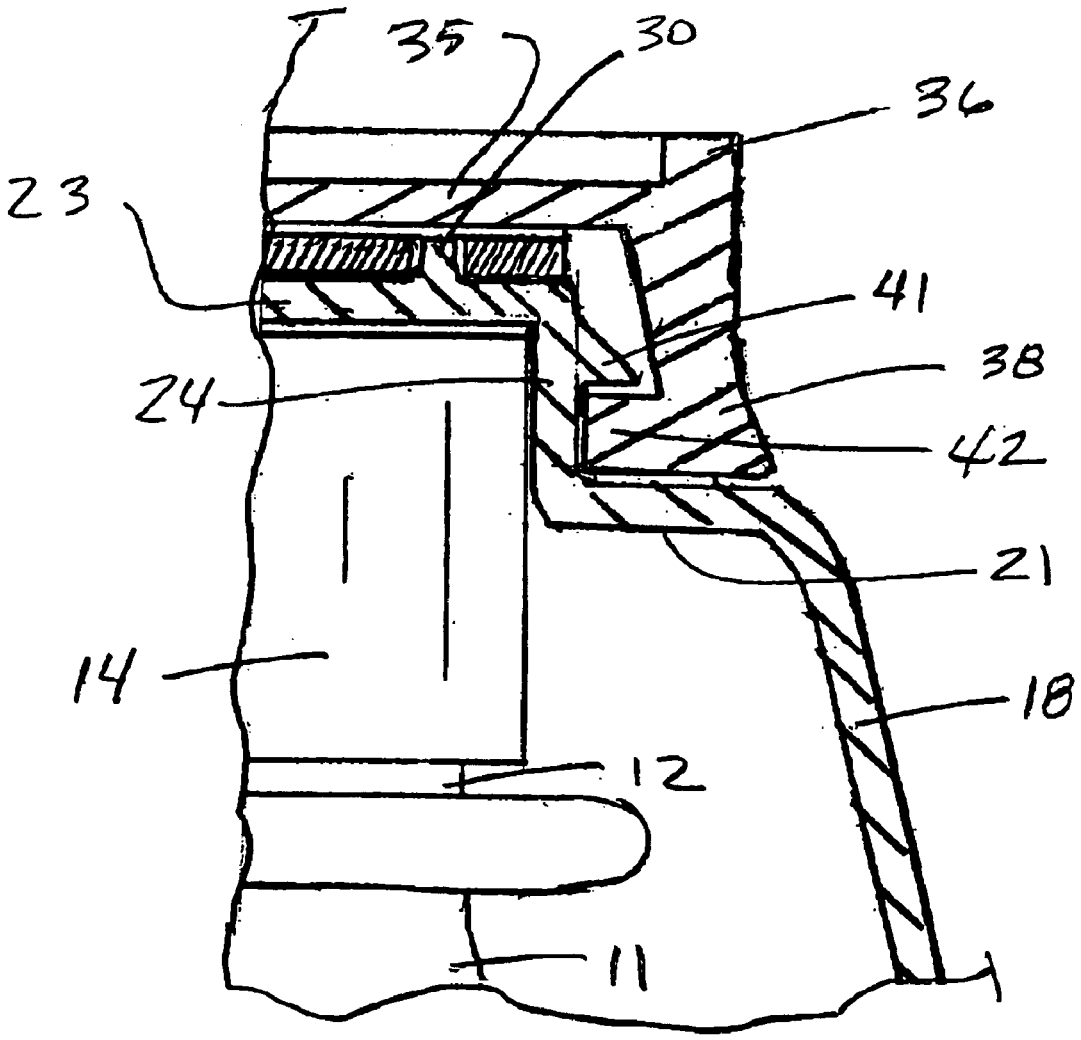
FIG. 2A is an enlarged view of a portion of the calculated dose medicine dispenser of FIG. 2.

Referring to the drawings, there is shown in FIGS. 1 and 2 a calculated dose medicine dispenser indicated generally at 10 installed on the top of a medicine bottle 11 of the type having a neck 12 and a standard cap 14 which may or may not be of the child proof variety. Medicine bottle 11 contains a supply of medicine and carries a label 15 that will generally give instructions as to dosage. The dosage will be dependent upon the age and/or weight of the young patient and is often in confusing and hard to understand terms. Dose dispenser 10 is tailored to a specific medication according to the manufacturer's label directions and is dimensioned to fit a specific bottle configuration containing that medicine.

Dose dispenser 10 provides a device for calculating the proper dose according to the patient, and then dispensing that dose to the patient. More particularly referring to FIGS. 2 through 5, the dose dispenser 10 includes a dosage cup 17 having a sidewall 18. Sidewall 18 can be clear, translucent or opaque and can be made of a suitable plastic material. Sidewall 18 will generally be curved and can be cylindrical or, as shown, truncated conical. Sidewall 18 can carry raised graduation marks 19 for the purpose of indicating a correctly measured amount of medicine in the cup. Graduation marks 19 can measure in terms of ounces, milliliters, cubic centimeters or other preferred units of measure.

The large diameter end of cup 17 is open and surrounded by a bead 20. The opposite small diameter end is closed by an end wall 21. End wall 21 has a circular indent 23 which is defined by a indent wall 24. Indent 23 has a diameter corresponding to that of bottle cap 14 so that it will closely fit the top of bottle cap 14 as shown in FIG. 2. Bottle cap 14 is held in frictional engagement in the indent 23.

The dose dispenser 10 includes the cup 17, a dial 26 and a data disc 27. Indent 23 forms a platform 29 on the exterior of bottom wall 21 of cup 17 (see FIG. 4) surrounded by a ledge 31. Data disc 27 fits on the platform 29. The platform 29 has one or more mounting pegs 30. The data disc 27 has corresponding mounting openings 32. The data disc 27 is held in place on the platform 29 by engagement of the mounting pegs 30 with the mounting openings 32.

It is understood that the data disc could be integral with the cup end wall with data information imprinted on the cup end wall.

Dial 26 has a generally cylindrical rim 34 connected to and surrounding a dial plate 35. A first rim section 36 extends from the dial plate 35 in a direction away from the cup 17. A second rim section 38 extends in the opposite direction. As shown in FIG. 2, the first rim section 36 is an upper rim and the second rim section 38 is a lower rim. Assembled as shown in FIG. 2, the dial plate 35 interfaces with the top surface of the data disc 27. The lower rim 39 interlocks relative to the platform 29 so that the dial 26 can be rotated with respect to the platform 29 and data disc 27.

Figure 4:
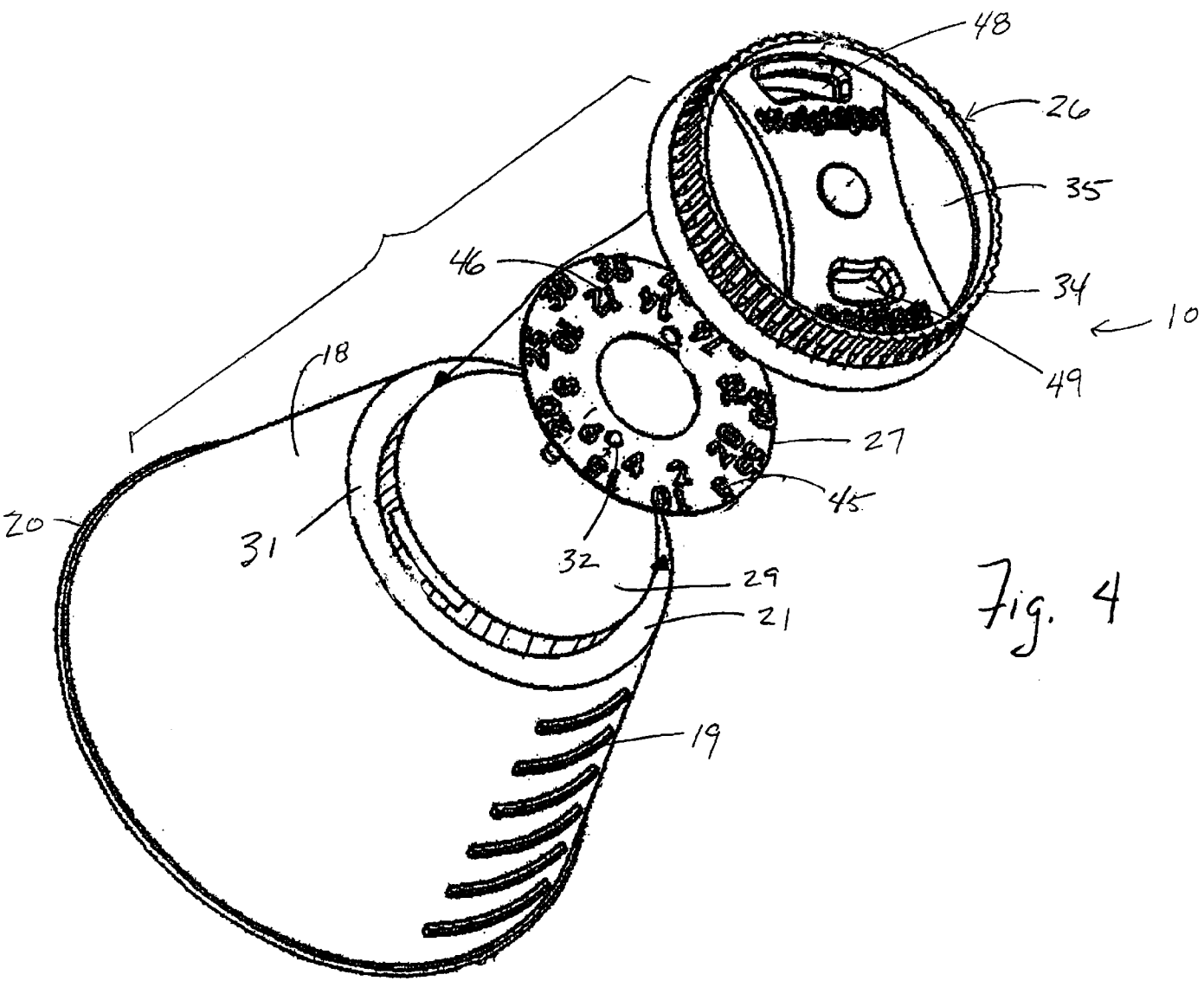
FIG. 4 is an assembly view of the calculated dose medicine dispenser of FIG. 3.
Figure 5:
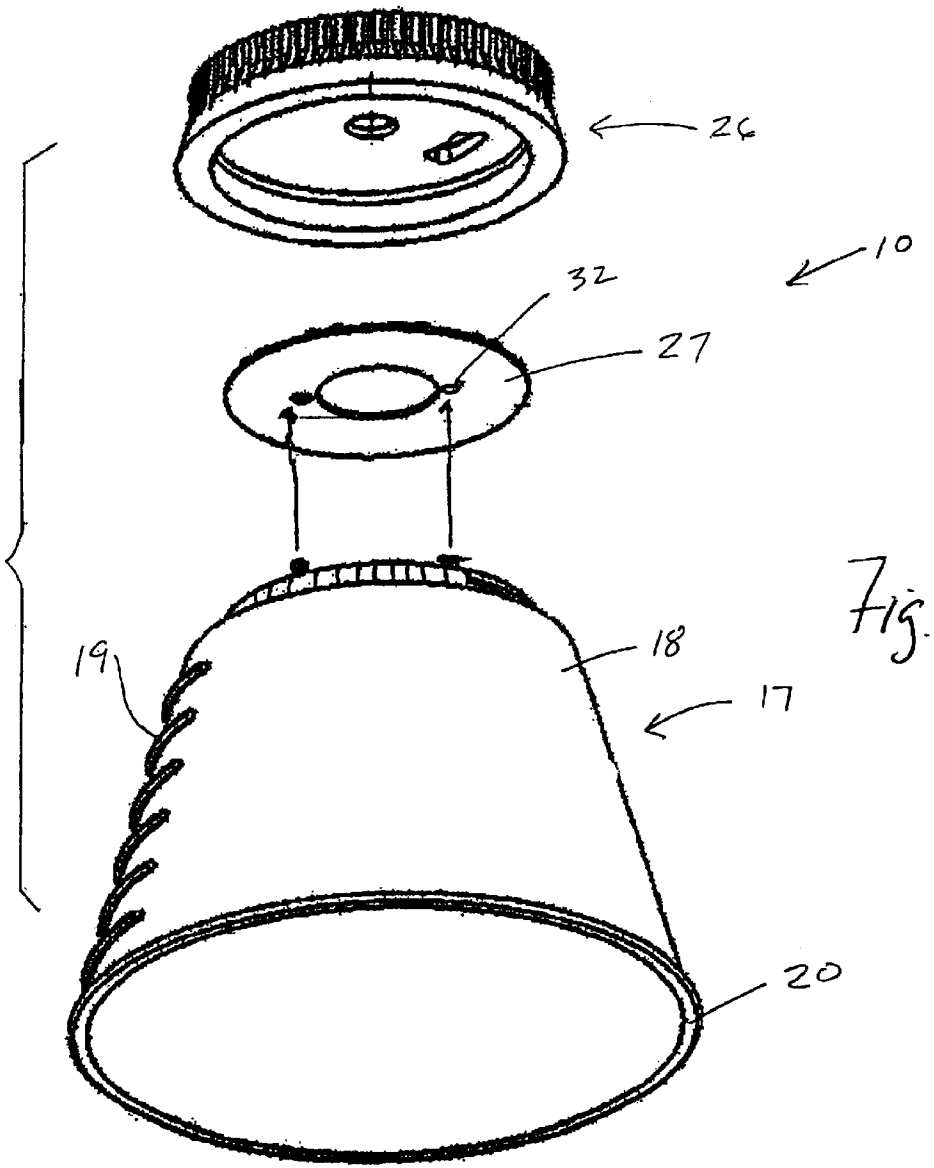
FIG. 5 is another assembly view of the calculated dose medicine dispenser of FIG. 3 taken from an end opposite that of FIG. 4.

The assembly of the dose dispenser 10 is shown in FIGS. 4 and 5. Lower rim 38 surrounds the data disc 27 and can rest on the ledge 31 of the cup 17. Dial 26 can be rotated relative to the stationary data disc 27 and platform 29. To this end, the upper rim portion 36 can have finger grip bumps 39 or like structure to facilitate rotation of the dial 26.

An interlock secures the dial 26 to the cup 17 with the data disc 27 in place with respect to the dial plate 35. In the embodiment shown, arcuate lip segments 41 extend out from the indent wall 24. The bottom edge of the lower rim 38 of dial 26 has an inwardly directed flange 42. Flange 42 is positioned beneath the arcuate lips 41 on the indent wall 24. The flange 42 is confined in a groove formed between the arcuate lips 41 and the ledge 31. The groove between the arcuate lips 41 and the ledge 31 provides a guideway for rotation of the dial 26. Lips 41 and flange 42 interlock to retain the dial 26 in position. Dial click stop serrations could be provided on confronting surfaces of the flange 42 and the drop wall 24 which would tend to maintain the dial 26 in a chosen location with respect to the platform 29 and data disc 27.

The dial 26 and the cup 17 can be made of somewhat flexible plastic. In the assembly of the dose dispenser 10, the data disc 27 can be positioned on the platform 29 through the use of the mounting pegs 30. Dial 26 is snapped in place by forcing the flanges 42 over the lip segments 41. Flanges 42 snap into place in the groove between the lip segments 41 and the ledge 31. Other suitable means could be provided for rotatably assembling the dial 26 to the cup 17 with the data disc 27 positioned between them as shown. The goal is to have the user rotatable dial 26 on top of the cup 17 for purposes of interacting with the data disc 27 to determine a proper dosage.

In the embodiment shown, the surface of data disc 27 in confronting relationship to the dial plate 35 carries at least two sets of information bits arranged in concentric, radially spaced apart rings. A first set 45 of information bits is comprised of individual discrete information bits which are shown to be values indicative of individual body weights. The information set 45 is arranged in an outer ring about the surface of data disc 27. A second set 46 of information bits is arranged in a concentric ring spaced radially inward from the first information set 45 and contains a second plurality of discrete data bits. In the embodiment shown, the discrete data bits of the second information set 46 comprise dosage values (see FIG. 4).

Dial plate 35 of dial 26 has a plurality of sight windows corresponding in number to the number of information sets carried by the data disc 27. As shown, plate 35 has a first sight window 48 positioned on plate 35 so that it traverses information bits in the first set 45 upon rotation of the dial 25. Sight window 48 displays one information bit at a time from the first information set to the exclusion of all other information bits. In the example shown the sight window 48 displays information pertaining to the weight variable of the intended juvenile patient and is so marked with the designation "weight" along with dimensions used.

The values of the information bits of the second set are functionally related on a one-to-one basis to values of the information bits in the first set. Plate 35 has a second sight window 49 positioned to traverse the information bits of the second set 46. Second sight window 49 displays one information bit at a time from the second set to the exclusion of the other information bits. The first and second sight windows are positionally arranged such that the information bit displayed in one window is functionally related on a one-to-one basis to the information bit simultaneously displayed in the other window.

In the embodiment shown, variables of the second set of information bits are dosage values that correspond in a one-to-one relationship to information bits of the first set. As shown, the second sight window 49 can be so marked with the designation "dose" together with a dimensional indication such as milliliters (ml). In the example shown in FIG. 3, setting the weight variable to "35" (in the first information set) results in a display in the second sight window of a dosage value of "2" indicating a proper dosage of 2 ml to the 35 pound patient of that specific medicine according to label directions.

Figure 3:
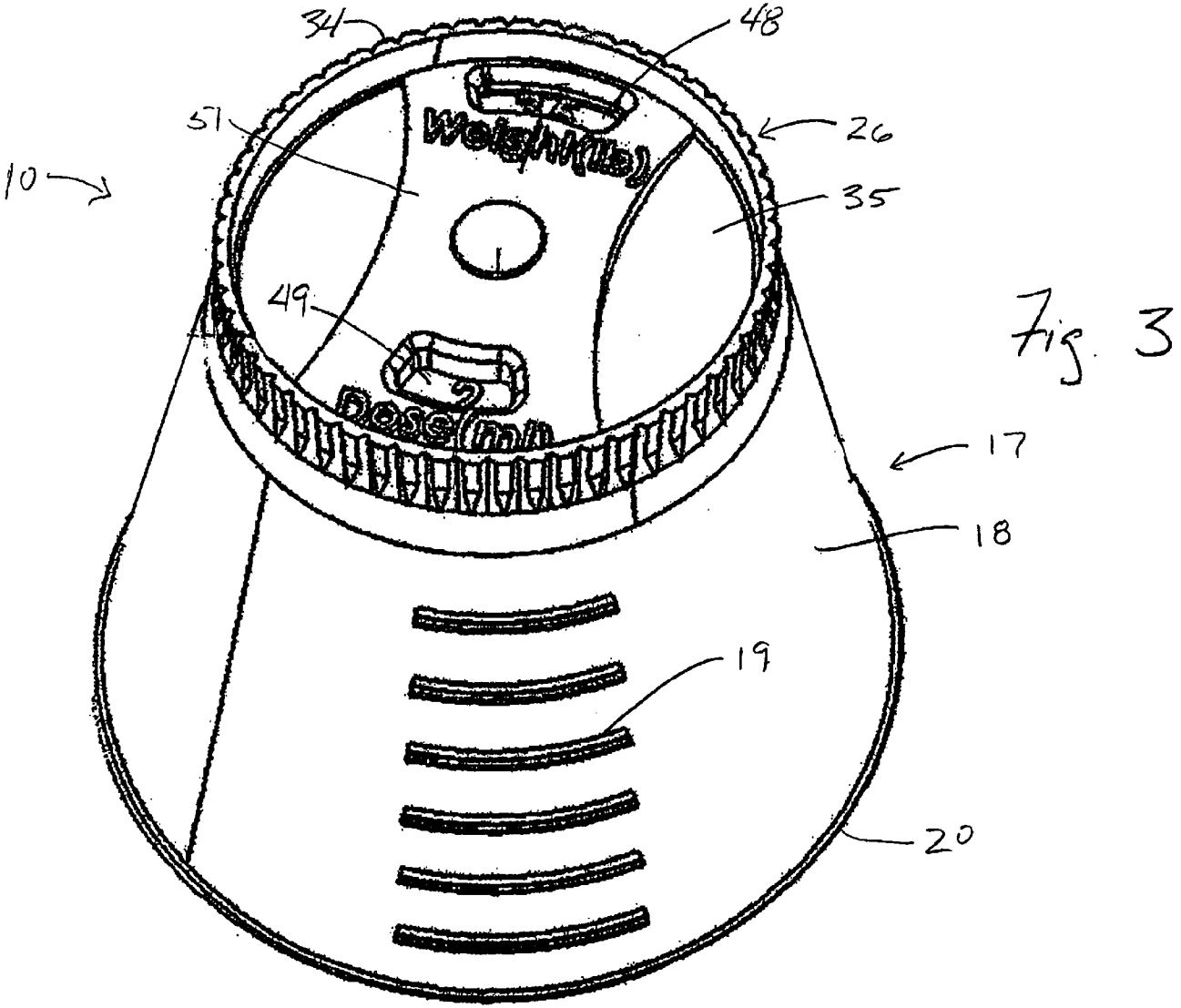
FIG. 3 is a top plan view in perspective showing the calculated dose medicine dispenser of FIG. 1 removed from the medicine bottle.

Continuing with the example shown in FIG. 3, the user dials in the value "35" for the weight variable as displayed in the first sight window 48. Plate 35 has a centrally raised ramp 51 providing for finger detents to facilitate rotation of dial 26. This results in a showing of the proper dosage of "2" in the second sight window 49. The user then disconnects the cup 17 from the medicine bottle 11 simply by pulling it away from the cap 14 against the friction fit provided by the indent 23. The graduations 19 on the cup 17 are calibrated in terms of the dosage units indicated by the data disc. In this case, the graduations 19 pertain to milliliters. The user dispenses the calculated dosage of medicine into the cup 17 by observing the graduations 19. The proper dose of medicine is then administered to the patient. Upon completion, the cup 17 is rinsed, if needed, and then replaced on the closed medicine bottle 11.

The dial assembly of the dosage dispenser provides the user with a means to determine the second bit of information from the second information set 46 that is a function of the first bit of information from the first information set 45. Generally the user will choose the first bit of information that indicates the known variable and use the dial indicator to determine the second bit of information that indicates the unknown quantity. In the example shown, the weight value of the juvenile is the known variable, and the dosage to be administered is the unknown variable. The second bit of information of the second set 46 is functionally related to the first bit of information from the first set 45 in a manner exclusive to all the other bits of information. It may be seen that a third set of information could also be provided along with a third sight window as may be indicated.

What is claimed is:

1. A calculated dose medicine dispenser for use in conjunction with a medicine bottle having a medicine bottle cap and containing a supply of medicine, comprising:

a dose cup having a conical sidewall with a large diameter open end and a smaller diameter closed end with an end wall closing the closed end;

indicia on the cup for indicating an amount of medicine in the cup;

an indent in the end wall with a diameter corresponding the diameter of a medicine bottle cap for a frictional fit of a medicine bottle cap;

a data disc carrying a first set of information bits in a first circular array, and a second set of information bits in a second circular array concentric with and radially spaced from the first circular array, said information bits in the first set being functionally related to the information bits in the second set;

a dial having a dial plate;

said data disc positioned on the exterior surface of the cup end wall and fixed from rotational movement thereon with said information sets facing away from the cup end wall;

said dial plate positioned over the data disc and interconnected with the cup permitting rotational movement of the dial plate relative to the data disc;

said dial plate having a first sight window positioned to individually display information bits from the first set of information;

said dial plate having a second sight window positioned to individually display information bits from the second information set such that an information bit displayed at the second sight window is functionally related to the information bit simultaneously displayed at the first sight window upon rotation of the dial plate relative to the cup.

2. The medicine dispenser of claim 1 including:

an indent wall describing said indent and providing a platform for supporting the data disc;

said dial having a rim surrounding the dial plate and the data disc;

interlock structure interconnecting the dial and the cup, said interlock structure including an outwardly projected arcuate lip segment on the indent wall and an inwardly directed flange on the dial rim.

3. The medicine dispenser of claim 2 wherein:

said rim has finger grip bumps to facilitate rotation of the dial.

4. The medicine dispenser of claim 2 wherein:

one set of information has information bits pertaining to weight and the other set of information has information bits pertaining to dosage.

5. The medicine dispenser of claim 4 wherein:

the indicia on the cup for indicating an amount of medicine in the cup comprise graduation marks.

6. The medicine dispenser of claim 2 wherein:

the dial and the cup are made of a flexible material whereby the dial can be snapped into place with respect to the cup.

7. The medicine dispenser of claim 6 wherein:

one set of information has information bits pertaining to weight and the other set of information has information bits pertaining to dosage.

8. The medicine dispenser of claim 6 wherein:

the indicia on the cup for indicating an amount of medicine in the cup comprise graduation marks.

9. The medicine dispenser of claim 8 including:

said data disc having a mounting opening;

said cup end wall having a mounting peg engaged with the mounting opening to restrain rotation of the data disc.

10. The medicine dispenser of claim 1 wherein:

one set of information has information bits pertaining to weight and the other set of information has information bits pertaining to dosage.

11. A calculated dose medicine dispenser apparatus comprising:

a dose cup having a cup sidewall with an open end and a closed end, said closed end being closed by an end wall;

indicia on the cup for indicating an amount of medicine in the cup;

a medicine bottle having a bottle neck closed by a bottle cap;

said dose cup having a dimension corresponding to the bottle cap such that the dose cup attaches to the bottle cap in frictional engagement with the open end of the dose cup facing the medicine bottle and covering the bottle cap;

a dial assembly installed on the dose cup and including a dial and a data disc;

said data disc carrying a first set of information bits in a first circular array, and a second set of information bits in a second circular array concentric with and radially spaced from the first circular array, said information bits in the first set being functionally related to the information bits in the second set;

said dial having a dial plate;

said data disc located on the exterior surface of the cup end wall and fixed from rotational movement thereon with said information sets facing away from the cup end wall;

said dial interconnected with the cup with the dial plate positioned over the data disc permitting rotational movement of the dial plate relative to the data disc;

said dial plate having a first sight window positioned to individually display information bits from the first set of information;

said dial plate having a second sight window positioned to individually display information bits from the second information set such that an information bit displayed at the second sight window is functionally related to the information bit simultaneously displayed at the first sight window upon rotation of the dial plate relative to the cup.

12. The medicine dispenser apparatus of claim 11 wherein:

said cup sidewall has a truncated conical shape with a large diameter end that is the open end.

13. The medicine dispensing apparatus of claim 12 wherein:

said end wall has a circular indent;

said bottle cap is cylindrical with a diameter so as to frictionally fit in the indent.

14. The medicine dispensing apparatus of claim 13 including:

an indent wall describing said indent and providing a platform for supporting the data disc;

said dial having a rim surrounding the dial plate and the data disc;

interlock structure interconnecting the dial and the cup, said interlock structure including an outwardly projected arcuate lip segment on the indent wall and an inwardly directed flange on the dial rim.

15. The medicine dispensing apparatus of claim 14 wherein:

one set of information has information bits pertaining to weight and the other set of information has information bits pertaining to dosage.

16. The medicine dispensing apparatus of claim 15 wherein:

the indicia on the cup for indicating an amount of medicine in the cup comprise graduation marks.

17. The medicine dispensing apparatus of claim 16 wherein:

dial and the cup are made of a flexible material whereby the dial can be snapped into place with respect to the cup.

18. The medicine dispensing apparatus of claim 14 wherein:

said rim has finger grip bumps to facilitate rotation of the dial.

19. The medicine dispensing apparatus of claim 12 wherein:

one set of information has information bits pertaining to weight and the other set of information has information bits pertaining to dosage.

20. A calculated dose medicine dispenser apparatus comprising:

a dose cup having a cup sidewall with an open end and a closed end, said closed end being closed by an end wall;

indicia on the cup for indicating an amount of medicine in the cup;

a medicine bottle having a bottle neck closed by a bottle cap;

said dose cup having a dimension corresponding to the bottle cap such that the dose cup attaches to the bottle cap in frictional engagement with the open end of the dose cup facing the medicine bottle and covering the bottle cap;

a dial assembly installed on the dose cup and including a first member and a second member;

said first member carrying a first set of information bits in a first array, and a second set of information bits in a second array spaced from the first array, said information bits in the first set being functionally related on a one-to-one basis to the information bits in the second set;

said first member located on an exterior surface of the cup and fixed from rotational movement thereon with said information sets facing away from the cup;

said second member interconnected with the cup and positioned over the first member permitting rotational movement of the second member relative to the first member;

said second member having a first sight window positioned to individually display information bits from the first set of information;

said second member having a second sight window positioned to individually display information bits from the second information set such that an information bit displayed at the second sight window is functionally related to the information bit simultaneously displayed at the first sight window whereby the second member is rotatable relative to the first member to display corresponding bits of information from the first and second sets of information bits.

21. A calculated dose medicine dispenser apparatus comprising:

a dose cup having a cup sidewall with an open end and a closed end, said closed end being closed by an end wall;

indicia on the cup for indicating an amount of medicine in the cup;

a medicine bottle having a bottle neck closed by a bottle cap;

said dose cup having a dimension corresponding to the bottle cap such that the dose cup attaches to the bottle cap in frictional engagement with the open end of the dose cup facing the medicine bottle and covering the bottle cap;

a dial assembly rotatably installed on the dose cup;

said dose cup end wall carrying data in the form of a first set of information bits in a first circular array, and a second set of information bits in a second circular array concentric with and radially spaced from the first circular array, said information bits in the first set being functionally related to the information bits in the second set;

said dial assembly having a dial plate covering the data carried by the dose cup end wall;

said dial plate having a first sight window positioned to individually display information bits from the first set of information;

said dial plate having a second sight window positioned to individually display information bits from the second information set such that an information bit displayed at the second sight window is functionally related to the information bit simultaneously displayed at the first sight window upon rotation of the dial plate relative to the cup.

* * * * *